US011325805B2

(12) United States Patent
Takahashi et al.

(10) Patent No.: US 11,325,805 B2
(45) Date of Patent: May 10, 2022

(54) ELECTRIC STAPLER, POST-PROCESSING DEVICE, AND IMAGE FORMING SYSTEM

(71) Applicant: MAX CO., LTD., Tokyo (JP)

(72) Inventors: Toshiyuki Takahashi, Tokyo (JP); Yoshio Chigira, Tokyo (JP)

(73) Assignee: MAX CO., LTD., Tokyo (JP)

( * ) Notice: Subject to any disclaimer, the term of this patent is extended or adjusted under 35 U.S.C. 154(b) by 0 days.

(21) Appl. No.: 17/245,046

(22) Filed: Apr. 30, 2021

(65) Prior Publication Data

US 2021/0339975 A1 Nov. 4, 2021

(30) Foreign Application Priority Data

Apr. 30, 2020 (JP) ..... JP2020-080671

(51) Int. Cl.

| | |
|---|---|
| ***B65H 37/04*** | (2006.01) |
| ***B31F 5/00*** | (2006.01) |
| ***B41L 43/12*** | (2006.01) |
| ***B42C 1/12*** | (2006.01) |

(52) U.S. Cl.

CPC ..... *B65H 37/04* (2013.01); *B31F 5/001* (2013.01); *B41L 43/12* (2013.01); *B42C 1/12* (2013.01); *B65H 2408/121* (2013.01); *B65H 2801/06* (2013.01); *G03G 2215/00822* (2013.01); *G03G 2215/00827* (2013.01); *G03G 2215/00848* (2013.01)

(58) Field of Classification Search

None

See application file for complete search history.

(56) References Cited

U.S. PATENT DOCUMENTS

| | | | | |
|---|---|---|---|---|
| 7,407,156 | B2 * | 8/2008 | Iizuka | B65H 31/24 270/58.11 |
| 8,191,884 | B2 * | 6/2012 | Sato | B42C 1/125 270/58.08 |
| 8,547,560 | B2 * | 10/2013 | Sato | G03G 15/6544 358/1.12 |
| 2020/0148498 | A1 * | 5/2020 | Ishida | G03G 15/6538 |

FOREIGN PATENT DOCUMENTS

| | | | |
|---|---|---|---|
| EP | 0779134 | B1 | 4/2000 |
| EP | 2251147 | B1 | 8/2016 |
| JP | 2011-201662 | A | 10/2011 |

OTHER PUBLICATIONS

Extended European Search Report for Application No. 21170709.6 dated Oct. 1, 2021 (9 pages).

* cited by examiner

*Primary Examiner* — Leslie A Nicholson, III

(74) *Attorney, Agent, or Firm* — Weihrouch IP

(57) ABSTRACT

An electric stapler includes a clamp part that is configured to include a first wall portion and a second wall portion for gripping a paper bundle, a penetration part that causes a staple to penetrate the paper bundle gripped by the clamp part, a clinch part that bends the staple penetrating the paper bundle to bind the paper bundle, a gripping release detection unit that detects that the paper bundle is released from gripping after the first wall portion moves in the direction of separating from the second wall portion from a state where the paper bundle is gripped by the clamp part; and an output unit that, after it is detected that the paper bundle is released from gripping of the clamp part, outputs a gripping release signal indicating that the paper bundle is released from gripping of the clamp part to an outside.

10 Claims, 12 Drawing Sheets

(1) BINDING COMMAND (MOTOR OPERATION STARTS)
(2) PAPER BUNDLE CLAMPING RELEASED
(3) MOTOR BRAKING STARTS AT HP SENSOR ON
(4) MOTOR STOPS
(5) UNNECESSARY STANDBY

DISCHARGE TIMING DETERMINATION BY CLOCKING SINCE HP SENSOR DETECTION (1) BINDING COMMAND (MOTOR OPERATION STARTS)
(2) CLOCKING FOR PAPER BUNDLE DISCHARGE START TIMING STARTS
(3) PAPER BUNDLE DISCHARGE STARTS AT CLOCKING COMPLETION (1) BINDING COMMAND (MOTOR OPERATION STARTS)
(2) COUNTING OF NUMBER OF PULSES STARTS AT HP SENSOR OFF
(3) BINDING COMPLETION NOTIFICATION ISSUED AT COUNTING COMPLETION → PAPER BUNDLE DISCHARGE STARTS
(4) MOTOR BRAKING STARTS AT HP SENSOR ON
(5) MOTOR STOPS (1) BINDING COMMAND (MOTOR OPERATION STARTS)
(2) COUNTING OF NUMBER OF PULSES STARTS AT HP SENSOR OFF
(3) BINDING COMPLETION NOTIFICATION ISSUED AT COUNTING COMPLETION → PAPER BUNDLE DISCHARGE STARTS
(4) MOTOR BRAKING STARTS AT HP SENSOR ON
(5) MOTOR STOPS

THICK PAPER BUNDLE (1) BINDING COMMAND (MOTOR OPERATION STARTS)
(2) COUNTING OF NUMBER OF PULSES STARTS AT HP SENSOR OFF
(3) BINDING COMPLETION NOTIFICATION ISSUED AT COUNTING COMPLETION → PAPER BUNDLE DISCHARGE STARTS
(4) MOTOR BRAKING STARTS AT HP SENSOR ON
(5) MOTOR STOPS (1) BINDING COMMAND (MOTOR OPERATION STARTS)
(2) COUNTING OF NUMBER OF PULSES STARTS AT HP SENSOR OFF
(3) BINDING COMPLETION NOTIFICATION ISSUED AT COUNTING COMPLETION → PAPER BUNDLE DISCHARGE STARTS
(4) MOTOR BRAKING STARTS AT HP SENSOR ON
(5) MOTOR STOPS

FIG. 8A

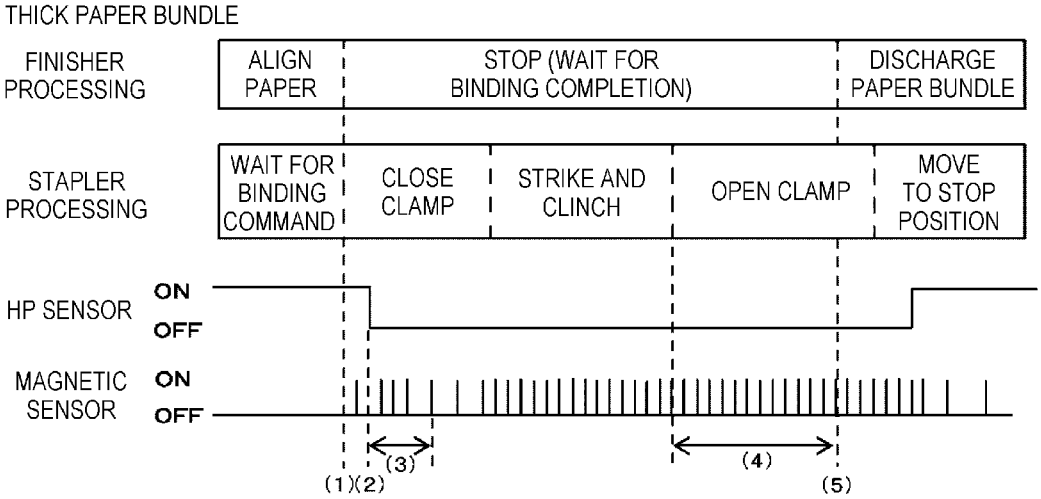

(1) BINDING COMMAND (MOTOR OPERATION STARTS)
(2) COUNTING OF NUMBER OF PULSES STARTS AT HP SENSOR OFF
(3) NUMBER OF PULSES GENERATED UNTIL LOAD FLUCTUATION IS COUNTED
·CALCULATE α = NUMBER OF PULSES GENERATED FROM CLAMPING START TO PAPER BUNDLE RELEASED
·α = LOWER-LIMIT PULSE VALUE IN CASE OF NO LOAD FLUCTUATION
(4)COUNT NUMBER α OF PULSES
(5)BINDING COMPLETION NOTIFICATION ISSUED AT COUNTING COMPLETION → PAPER BUNDLE DISCHARGE STARTS

FIG. 8B

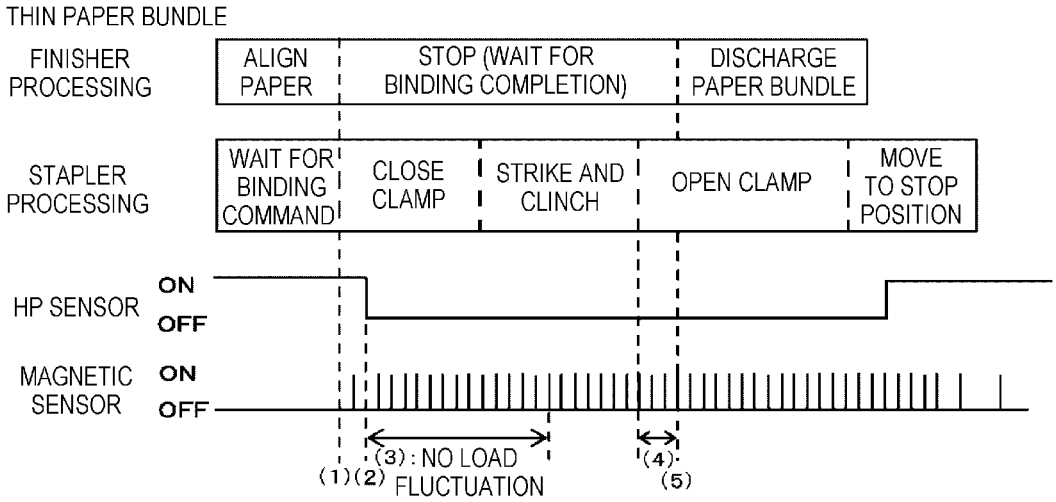

(1) BINDING COMMAND (MOTOR OPERATION STARTS)
(2) COUNTING OF NUMBER OF PULSES STARTS AT HP SENSOR OFF
(3) NUMBER OF PULSES GENERATED UNTIL LOAD FLUCTUATION IS COUNTED
·CALCULATE α = NUMBER OF PULSES GENERATED FROM CLAMPING START TO PAPER BUNDLE RELEASED
·α = LOWER-LIMIT PULSE VALUE IN CASE OF NO LOAD FLUCTUATION
(4)COUNT NUMBER α OF PULSES
(5)BINDING COMPLETION NOTIFICATION ISSUED AT COUNTING COMPLETION → PAPER BUNDLE DISCHARGE STARTS

ELECTRIC STAPLER, POST-PROCESSING DEVICE, AND IMAGE FORMING SYSTEM

CROSS-REFERENCE TO RELATED APPLICATION

This application is based upon and claims the benefit of priority from prior Japanese patent application No. 2020-080671, filed on Apr. 30, 2020, the entire contents of which are incorporated herein by reference.

TECHNICAL FIELD

The present invention relates to an electric stapler that binds a paper bundle with a staple, a post-processing device on which the electric stapler is mounted, and an image forming system including the post-processing device.

BACKGROUND ART

In an image forming system, which includes an image forming device using an electrophotographic technique and a post-processing device, the post-processing device may be equipped with an electric stapler that binds a paper bundle with a staple.

The electric stapler includes a home position sensor that detects a rotational position of a gear driven by a motor, and is configured such that an output of the home position sensor becomes a predetermined output after a clamping process of clamping a paper bundle, a penetrating process of causing a staple to penetrate the paper bundle, and a clinching process of bending the staple are completed and clamping is released.

In the electric stapler, the bound paper bundle being dischargeable is detected based on the output of the home position sensor, and is output to the post-processing device. In the post-processing device, when a notification that the bound paper bundle is being dischargeable is received from the electric stapler, discharge processing of the paper bundle is performed.

On the other hand, there has been proposed a technique of determining detection of a home position sensor and determining a timing at which a paper bundle can be discharged with the passage of time (for example, see Patent Literature 1).

CITATION LIST

Patent Literature

Patent Literature 1: JP-A-2011-201662

SUMMARY OF INVENTION

Technical Problem

In the electric stapler, when the clinching process ends and an operation of releasing the clamping starts, the paper bundle can be discharged. However, in a method of detecting, based on an output of a home position sensor, that a bound paper bundle can be discharged, discharge is not performed until an output signal from the home position sensor is received even though the paper bundle is actually in a dischargeable state, and therefore, unnecessary waiting is caused in a period from when the dischargeable state is established to when the output signal from the home position sensor is received.

In addition, the time until completion of the clinching process varies depending on magnitude of a load (for example, whether the paper bundle is thin or thick). Accordingly, in a method of determining a timing at which the paper bundle can be discharged with the passage of time, when the timing at which the paper bundle can be discharged with the passage of time is determined on a basis of a case where the load is small (for example, a case where the paper bundle is thin), there is a possibility that the discharge of the paper bundle is started before the completion of the clinching process in a case where the load is large. In such a case, the post-processing device starts discharging the paper bundle although the stapler clamps the paper bundle, which is a main cause of a jam or a mechanical failure.

It is therefore an exemplary object of the present invention to provide an electric stapler capable of detecting a suitable discharge timing, preferably an optimum discharge timing, of a paper bundle. In addition, it is an exemplary object to provide a post-processing device on which such an electric stapler is mounted, and an image forming system including the post-processing device.

Solution to Problem

In order to solve the above-described problem, an electric stapler according to the present disclosure is an electric stapler, including: a clamp part that is configured to include a first wall portion and a second wall portion facing each other with a predetermined gap therebetween, in which the first wall portion is movable in directions of approaching and separating from the second wall portion, and that grips a paper bundle inserted between the first wall portion and the second wall portion by moving the first wall portion in the direction of approaching the second wall portion; a penetration part that causes a staple to penetrate the paper bundle gripped by the clamp part; a clinch part that bends the staple penetrating the paper bundle to bind the paper bundle; a gripping release detection unit that detects that the paper bundle is released from gripping after the first wall portion moves in the direction of separating from the second wall portion from a state where the paper bundle is gripped by the clamp part; and an output unit that, after it is detected that the paper bundle is released from gripping of the clamp part, outputs a gripping release signal indicating that the paper bundle is released from gripping of the clamp part to an outside.

In the above-described electric stapler, when it is detected that the paper bundle is released from gripping of the clamp part, a gripping release signal is output to the outside, and processing based on the gripping release signal is performed.

Advantageous Effects

According to the electric stapler described above, since a gripping release signal is output when it is detected that a paper bundle is actually released from gripping of a clamp part, it is possible to detect a suitable discharge timing, preferably an optimum discharge timing, of the paper bundle.

BRIEF DESCRIPTION OF DRAWINGS

FIG. 8A is a time chart illustrating a third operation example of the electric stapler according to the present embodiment.

FIG. 8B is a time chart illustrating the third operation example of the electric stapler according to the present embodiment.

DESCRIPTION OF EMBODIMENTS

Hereinafter, embodiments of an electric stapler, a post-processing device on which the electric stapler is mounted, and an image forming system including the post-processing device according to the present invention will be described with reference to the drawings.

<Configuration Example of Electric Stapler of Embodiment>

Figure 1:
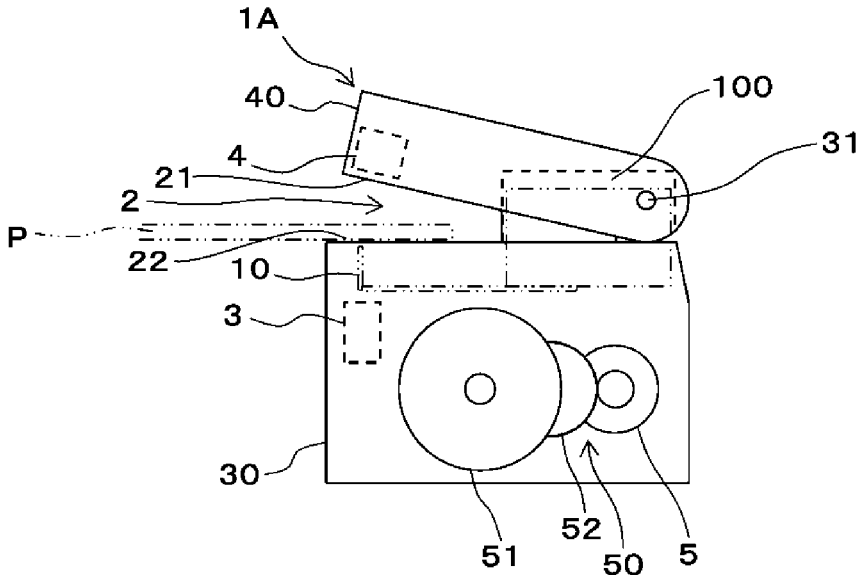
FIG. 1 is a side view illustrating an example of an electric stapler according to an embodiment.

FIG. 1 is a side sectional view illustrating an example of an electric stapler according to an embodiment.

An electric stapler 1A includes a clamp part 2 that clamps a paper bundle P, a penetration part 3 that causes a staple 10 to penetrate the paper bundle P, and a clinch part 4 that bends the staple 10 penetrating the paper bundle P to bind the paper bundle P. In addition, the electric stapler 1A includes a motor 5 that drives the clamp part 2, the penetration part 3, and the clinch part 4.

The electric stapler 1A includes a striking unit 30 in which the penetration part 3 is provided, and a binding unit 40 in which the clinch part 4 is provided.

The clamp part 2 includes a first wall portion 21 and a second wall portion 22 that face each other with a predetermined gap therebetween. In the clamp part 2, the first wall portion 21 is formed at a portion facing the striking unit 30 of the binding unit 40. Further, in the clamp part 2, the second wall portion 22 is formed at a portion facing the binding unit 40 of the striking unit 30.

The binding unit 40 moves in directions approaching and separating from the striking unit 30 by a rotating operation with a shaft 31 serving as a fulcrum.

Accordingly, in the clamp part 2, the first wall portion 21 moves in directions of approaching and separating from the second wall portion 22. The clamp part 2 sandwiches the paper bundle P between the first wall portion 21 and the second wall portion 22 when the first wall portion 21 is moved in a direction of approaching the second wall portion 22. When the first wall portion 21 moves in a direction of separating from the second wall portion 22, the paper bundle P sandwiched between the first wall portion 21 and the second wall portion 22 is released.

A cartridge 100, in which the staples 10 are accommodated in a connected state, is detachably attached to the striking unit 30. The penetration part 3 separates one leading staple of the staples 10 accommodated in the cartridge 100, and strikes the staple 10 toward the paper bundle P sandwiched between the first wall portion 21 and the second wall portion 22 to penetrate the paper bundle P. The penetration part 3 may include a movable part movable between a first position and a second position. The second position is apart from the first position in the direction orthogonal to a surface of the paper bundle.

The striking unit 30 includes a mechanism that feeds the staple 10 accommodated in the cartridge 100 to a position where the staple 10 can be struck by the penetration part 3. In addition, the striking unit 30 includes a mechanism that forms the staple 10 into a U shape, with the staples in a form of being connected in a sheet shape and accommodated in the cartridge 100 for supply.

The clinch part 4 bends the staple 10 penetrating the paper bundle P sandwiched between the first wall portion 21 and the second wall portion 22 in a predetermined direction. The binding unit 40 may include a mechanism that cuts legs of the staple 10 penetrating the paper bundle P. The clinch part 4 may include a contact surface which comes into contact with the staple 10 to bend the staple 10.

Figure 2:
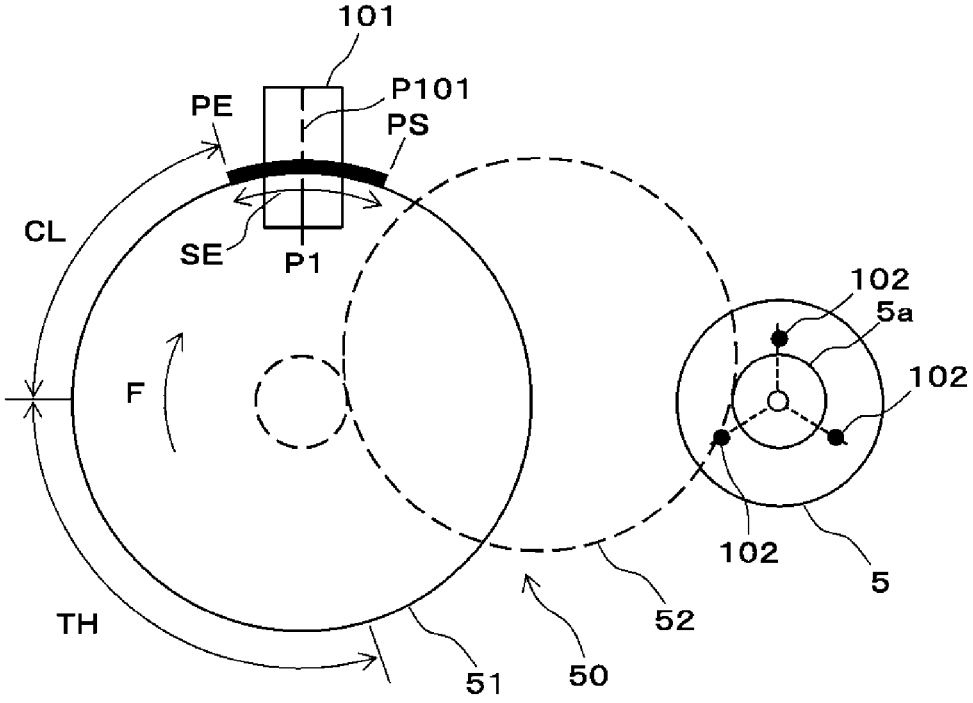
FIG. 2 is a side sectional view illustrating an example of a driving unit.

FIG. 2 is a side sectional view illustrating an example of a driving unit. The electric stapler 1A includes a driving unit 50 that transmits rotation of the motor 5 to the clamp part 2, the penetration part 3, and the clinch part 4. The driving unit 50 includes a driven gear 51 that transmits the rotation of the motor 5 to the clamp part 2, the penetration part 3, and the clinch part 4, and an intermediate gear 52 that transmits the rotation of the motor 5 to the driven gear 51.

In the driving unit 50, rotation of a motor shaft 5*a* of the motor 5 is transmitted to the driven gear 51 via the intermediate gear 52, and the driven gear 51 rotates. When rotation of the driven gear 51 is transmitted to a cam or the like (not illustrated), the driving unit 50 moves the binding unit 40 in directions of approaching and separating from the striking unit 30, and opens and closes the clamp part 2. In addition, the driving unit 50 drives the penetration part 3 and the clinch part 4 by transmitting the rotation of the driven gear 51 to a cam or the like (not illustrated).

In the electric stapler 1A, in an operation of the driven gear 51 rotating in one direction, the binding unit 40 moves in a direction of approaching the striking unit 30, and the paper bundle P is clamped by the clamp part 2.

Further, in the electric stapler 1A, in the operation of the driven gear 51 rotating in the one direction, the staples 10 accommodated in the cartridge 100 are fed out, and one leading staple 10 of the fed-out staples 10 is struck by the penetration part 3 toward the paper bundle P clamped by the clamp part 2 to penetrate the paper bundle P.

Further, in the electric stapler 1A, in the operation of the driven gear 51 rotating in the one direction, the staple 10 penetrating the paper bundle P is bent by the clinch part 4 by, and in the operation of the driven gear 51 further rotating in the one direction, the binding unit 40 is moved in a direction of separating from the striking unit 30, and the clamping of the paper bundle P by the clamp part 2 is released.

Further, in the operation of the driven gear 51 rotating in the one direction, the electric stapler 1A performs a clamping process of clamping the paper bundle P with the clamp part 2, a penetrating process of striking the staple 10 into the paper bundle P with the penetration part 3, a clinching process of bending the staple 10 with the clinch part 4, and a returning process of releasing the paper bundle P clamped by the clamp part 2.

Next, a configuration for detecting positions and rotation amounts of the motor 5 and the driven gear 51 in a rotation direction will be described.

In the electric stapler 1A, a position along a rotation direction of the motor shaft 5*a* of the motor 5 is referred to as a rotational position of the motor 5. In addition, a position along a rotation direction of the driven gear 51 is referred to as a rotational position of the driven gear 51.

In the driving unit 50, the driven gear 51 meshes with the intermediate gear 52 and the intermediate gear 52 meshes with a gear (not illustrated) of the motor shaft 5*a*, and thus a rotational speed of the driven gear 51 is a value obtained by reducing a rotational speed of the motor 5 at a predetermined reduction ratio. Accordingly, a rotational position and a rotation amount of the driven gear 51 are proportional to a rotational position and a rotation amount of the motor 5.

Therefore, a home position sensor 101 (first position detection unit) that detects a rotational position of the driven gear 51 is provided for the rotational positions of the motor 5 and the driven gear 51. With respect to the rotation amounts of the motor 5 and the driven gear 51, the rotation amount of the motor 5 is detected based on an output of a magnetic sensor 102 (rotation amount detection unit) used for detecting a position of a rotor (not illustrated) of the motor 5 that is configured with a brushless motor.

In the electric stapler 1A, the home position sensor 101 detects the rotational position of the driven gear 51 in order to cause the clamp part 2, the penetration part 3, and the clinch part 4 to standby at a predetermined home position.

In the electric stapler 1A, a stop target range SE is set to a predetermined range in a circumferential direction of the driven gear 51 in order to stop the rotational position of the driven gear 51 at a predetermined position when stopping driving of the motor 5 or in order to detect a timing for discharging the paper bundle P.

The electric stapler 1A is configured such that an output of the home position sensor 101 changes from 0 (OFF) to 1 (ON), for example, when a stop target range start-point position PS, which is a start-point of the stop target range SE, reaches a detection position P101 of the home position sensor 101 with respect to rotation of the driven gear 51 in a forward direction indicated by an arrow F.

Further, the electric stapler 1A is configured such that the output of the home position sensor 101 changes from 1 (ON) to 0 (OFF), for example, when a stop target range end-point position PE, which is an end-point of the stop target range SE, reaches the detection position P101 of the home position sensor 101 with respect to the rotation of the driven gear 51 in the forward direction indicated by the arrow F.

Accordingly, the electric stapler 1A is configured such that the home position sensor 101 can detect the stop target range SE of the driven gear 51.

In the electric stapler 1A, the stop target position P1 of the driven gear 51 is set within the stop target range SE. In the electric stapler 1A, when the stop target position P1 of the driven gear 51 is located at the detection position P101 of the home position sensor 101, the clamp part 2, the penetration part 3, and the clinch part 4 are located at respective home positions.

In the electric stapler 1A, when the driven gear 51 is rotated in the forward direction indicated by the arrow F by forward rotation of the motor 5 from a state where the stop target position P1 of the driven gear 51 is located at the detection position P101 of the home position sensor 101, the stop target range end-point position PE reaches the detection position P101 of the home position sensor 101.

With respect to the rotation of the driven gear 51 in the forward direction indicated by the arrow F, a predetermined range from the stop target range end-point position PE is set as a clamp range CL in which clamping of the paper bundle P by the clamp part 2 is performed in the clamping process. Further, following the clamp range CL, a penetration range TH is set in which the staple 10 is struck into the paper bundle P by the penetration part 3 in the penetrating process. Following the penetration range TH, a clinch range of the clinching process is set, and following the clinch range, a clamp release range of the returning process is set, met by the stop target range start-point position PS.

Figure 3:
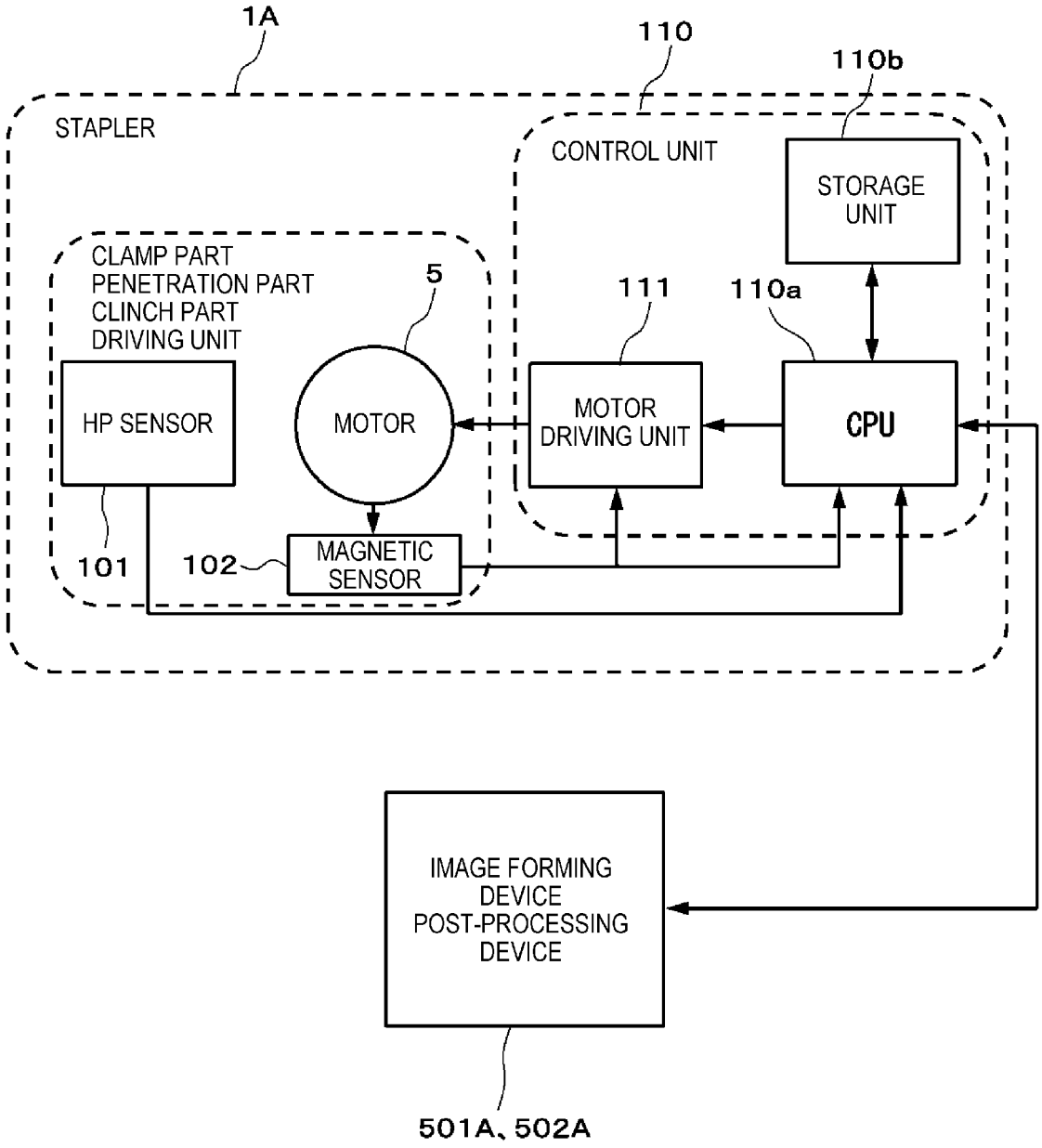
FIG. 3 is a block diagram illustrating an example of control functions of the electric stapler.

FIG. 3 is a block diagram illustrating an example of control functions of the stapler. The electric stapler 1A includes a control unit (controller) 110 that controls the motor 5 and a motor driving unit (a motor driving circuit) 111 that drives the motor 5.

The control unit 110 (implementing a gripping release detection unit, a paper bundle thickness information acquisition unit, a paper sheet number acquisition unit, an output unit, a load fluctuation detection unit, and a thickness estimation unit) includes a CPU 110*a*, and executes the binding processing of the electric stapler 1A by executing a program stored in a storage unit 110*b*. The motor driving unit 111 drives the motor 5 by known PWM control based on position information of a rotor (not illustrated) output from the magnetic sensor 102.

The control unit 110 detects the timing, at which the paper bundle P can be discharged, based on the rotational position of the driven gear 51 detected by the home position sensor 101 and the rotation amount of the motor 5 detected by the magnetic sensor 102, that is, the rotation amount of the driven gear 51.

<Configuration Example of Image Forming System and Post-Processing Device>

Figure 4:
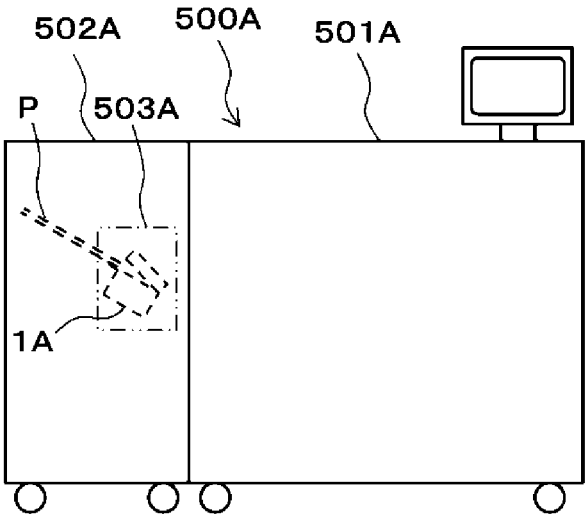
FIG. 4 is a configuration diagram illustrating an overview of an image forming system according to the present embodiment.

FIG. 4 is a configuration diagram illustrating an overview of an image forming system according to the present embodiment. An image forming system 500A of the present embodiment includes an image forming device 501A and a post-processing device 502A that is capable of performing at least one type of processing. The image forming device 501A forms and outputs an image on a sheet of paper fed from a paper feeding portion (not illustrated) inside or outside the device. In this example, the image forming device 501A forms an image on a sheet of paper by forming an electrostatic latent image by scanning exposure, developing the electrostatic latent image with toner, transferring the toner to the sheet of paper, and fixing the toner. The post-processing device 502A includes the above-described electric stapler 1A in a binding part 503A.

In the electric stapler 1A, the CPU 110*a* of the control unit 110 illustrated in FIG. 3 is connected to a control unit (not illustrated) of the post-processing device 502A and a control unit (not illustrated) of the image forming device 501A. The image forming device 501A instructs the post-processing device 502A to perform the binding processing when performing the binding processing of binding the paper bundle P is selected by an operation part (not illustrated). The post-processing device 502A performs paper alignment processing of aligning a predetermined number of sheets of paper output from the image forming device 501A, and outputs a binding command to the stapler 1A when the paper alignment processing is completed. In addition, when the paper bundle P is bound by the stapler 1A and a binding completion notification is received at a predetermined timing to be described later, the post-processing device 502A performs discharge processing of the bound paper bundle P. When there is paper to be bound next, the paper alignment processing is performed to align the paper to be bound next.

<Operation Example and Problem of Electric Stapler in Related Art>

Figure 5A:
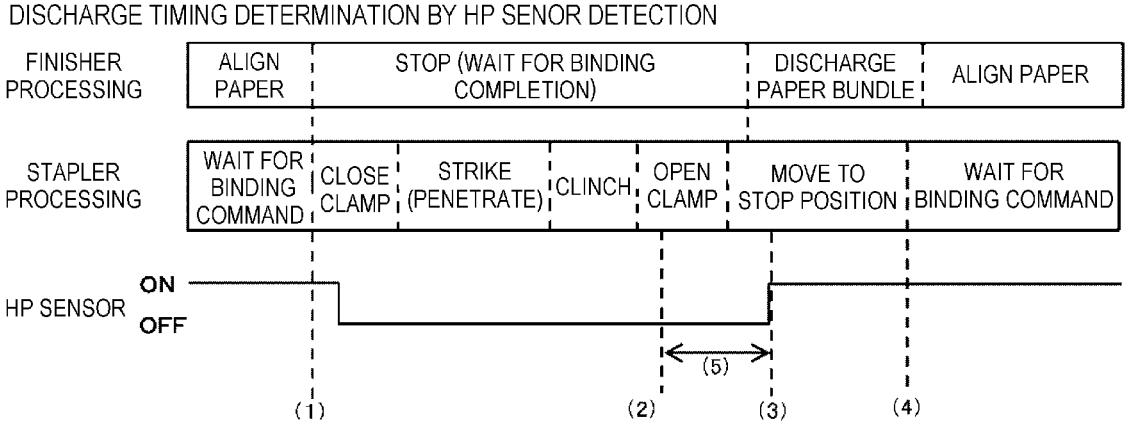
FIG. 5A is a time chart illustrating an operation example of an electric stapler in the related art.

FIG. 5 is a time chart illustrating an operation example of an electric stapler in the related art. A specific example of the problem described in the section of "Technical Problem" will be described. FIG. 5A illustrates an example in which a timing at which the paper bundle P can be discharged is determined based on ON-OFF-ON detection of the home position sensor. Note that FIG. 1 and the like are used for the configuration of the electric stapler in the related art.

The electric stapler 1A is configured such that after the home position sensor 101 detects the stop target range end-point position PE of the driven gear 51 illustrated in FIG. 2 (detection of HP sensor OFF), the clamping process, the penetrating process, and the clinching process are completed, and after the clamp part 2 is opened, the home position sensor 101 detects the stop target range start-point position PS of the driven gear 51 (detection of HP sensor ON).

However, before a timing at which the home position sensor 101 detects the stop target range start-point position PS of the driven gear 51 (detection of HP sensor ON), the clinching process is completed and an operation of the opening the clamp part 2 starts, and actually the paper bundle P can be discharged. Therefore, as indicated by (5) of FIG. 5A, unnecessary waiting occurs in a period from when actually the paper bundle P can be discharged to when the HP sensor ON is detected.

Figure 5B:
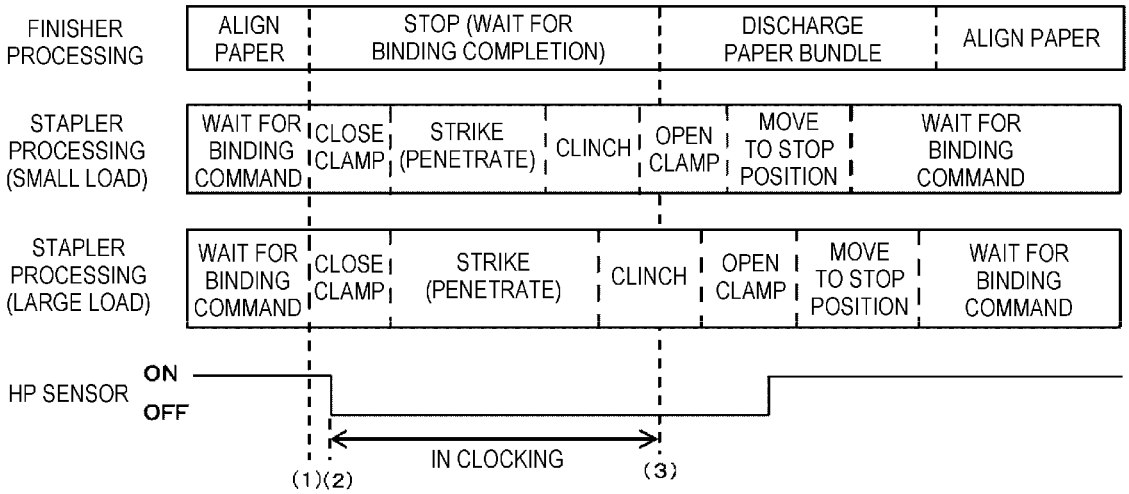
FIG. 5B is a time chart illustrating an operation example of the electric stapler in the related art.

FIG. 5B illustrates an example in which a timing at which the paper bundle P can be discharged is determined with the passage of time since detection of the home position sensor OFF.

In a case where a load is small, a force for causing the staple 10 to penetrate the paper bundle P is smaller than that in a case where the load is large. Accordingly, a rotational speed of the motor 5 in stapler processing is increased. On the other hand, in the case where the load is large, the force for causing the staple 10 to penetrate the paper bundle P is larger than that in the case where the load is small. Accordingly, the rotational speed of the motor 5 in the stapler processing is reduced.

Therefore, time from when the home position sensor 101 detects the stop target range end-point position PE of the driven gear 51 (detection of HP sensor OFF) to when the clinching process is completed varies depending on the magnitude of the load. Normally, the time from when the home position sensor 101 detects the stop target range end-point position PE of the driven gear 51 (detection of HP sensor OFF) to when the clinching process is completed is shorter in the case where the load is small than in the case where the load is large.

Accordingly, as illustrated in FIG. 5B, when the timing at which the paper bundle P can be discharged is determined with the passage of time since the detection of the home position sensor 101 OFF on the basis of the case where the load is small, there is a possibility that the discharge of the paper bundle P is started before completion of the clinching process in the case where the load is large. In such a case, the post-processing device starts discharging the paper bundle although the stapler clamps the paper bundle, which is a main cause of a jam or a mechanical failure.

<Operation Example of Electric Stapler of Present Embodiment>

Figure 6A:
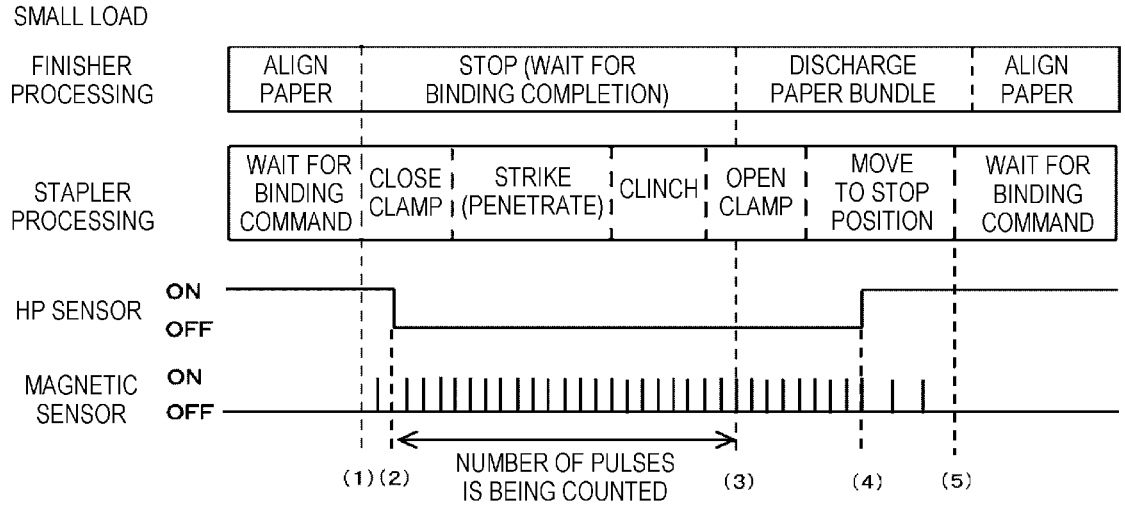
FIG. 6A is a time chart illustrating a first operation example of the electric stapler according to the present embodiment.
Figure 6B:
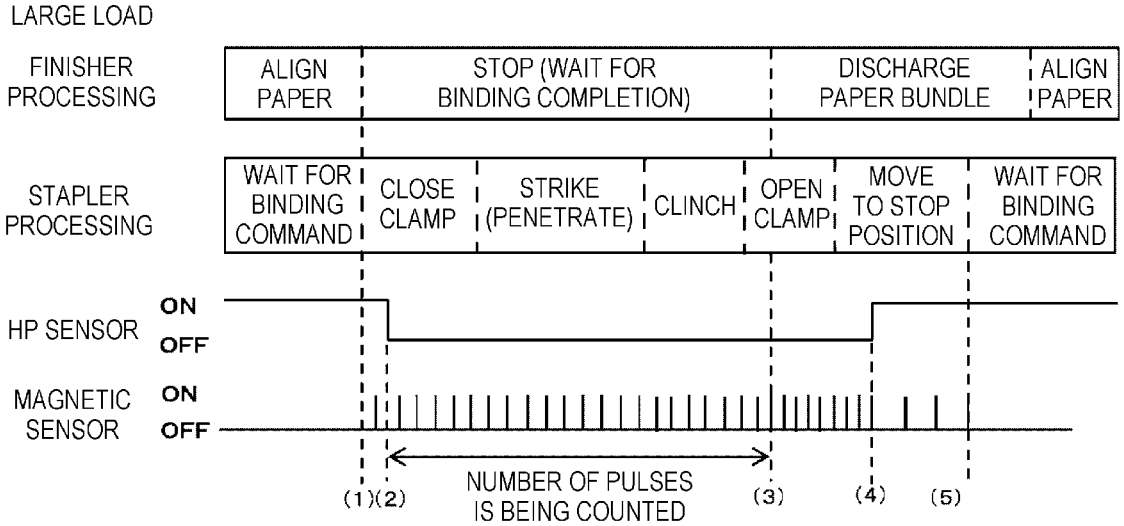
FIG. 6B is a time chart illustrating the first operation example of the electric stapler according to the present embodiment.

FIGS. 6A and 6B are time charts illustrating a first operation example of the electric stapler according to the present embodiment, in which FIG. 6A illustrates a case where the load is small due to a small number of sheets of paper to be bound or the like, and FIG. 6B illustrates a case where the load is large due to a large number of sheets of paper to be bound or the like.

When the paper alignment processing is completed, the post-processing device 502A illustrated in FIG. 4 outputs a binding command to the stapler 1A. Until the paper alignment processing is completed and a binding command is issued in finisher processing in the post-processing device 502A, the control unit 110 of the stapler 1A does not drive the motor 5 and does not execute the stapler processing.

When a binding command from the post-processing device 502A is received correspondingly to a binding command at (1) in FIGS. 6A and 6B, the control unit 110 rotates the motor 5 forward to rotate the driven gear 51 illustrated in FIG. 2 in one direction indicated by the arrow F.

When the home position sensor 101 detects the stop target range end-point position PE of the driven gear 51, that is, HP sensor OFF is detected at (2) in FIGS. 6A and 6B, the control unit 110 starts counting the number of pulses from the magnetic sensor 102. At the start of counting the number of pulses, rotation amount information D1 is acquired based on position information output from the magnetic sensor 102. The rotation amount information D1 is the number of pulses obtained by counting the number of pulses generated based on the position information accompanying the rotation of the motor 5.

In this example, a rotation amount (the number of pulses) of the motor 5 in a period from when the home position sensor 101 detects the stop target range end-point position PE of the driven gear 51 to when the paper bundle P can be discharged is determined in advance. During the period, the clamping process, the penetrating process, and the clinching process are completed, and thereafter the first wall portion 21 starts to move in a direction of separating from the second wall portion 22 so that the clamp part 2 is opened. The rotation amount is, for example, a rotation amount of the motor 5 at the time when clamping of the paper bundle P with a maximum number of sheets that can be bound in the electric stapler 1A can be released. The rotation amount of the motor 5 in the period from when the stop target range end-point position PE of the driven gear 51 is detected to when the paper bundle P can be discharged is referred to as a discharge-possible rotation amount D2, during which the clinching process is completed and the clamp part 2 is opened. However, the discharge-possible rotation amount D2 is set before the home position sensor is turned ON.

When the rotation amount information D1, which is acquired based on the position information output from the magnetic sensor 102 after the stop target range end-point position PE of the driven gear 51 is detected, reaches the discharge-possible rotation amount D2, the control unit 110 determines that the paper bundle P can be released from the clamping (gripping), and outputs a binding completion notification (gripping release signal) to the post-processing device 502A correspondingly to counting completion at (3) in FIGS. 6A and 6B. The electric stapler 1A may include an interface for outputting the signal. In this example, the rotation amount of the motor 5, that is, the number of pulses at which the paper bundle P can be discharged is constant. But as indicated by (2)-(3) of FIG. 6A, in the case where the load is small, for example, when the paper bundle P is thin, the motor 5 rotates faster, and as indicated by (2)-(3) of FIG. 6B, in the case where the load is large, for example, when the paper bundle P is thick, the motor 5 rotates slower than when the load is small.

When the binding completion notification from the stapler 1A is received, the post-processing device 502A performs the discharge processing of the paper bundle P. In a case where there is paper to be bound next when the discharge processing of the paper bundle P is completed, the paper alignment processing is performed to align the paper to be bound next.

When the home position sensor 101 detects the stop target range start-point position PS of the driven gear 51, that is, the HP sensor ON is detected at (4) in FIGS. 6A and 6B, the control unit 110 performs braking control of stopping the driving of the motor 5. This braking control is also referred to as braking or applying a brake.

After the HP sensor ON is detected at (4) in FIGS. 6A and 6B, the control unit 110 stops the rotation of the motor 5 correspondingly to motor stop at (5) of FIGS. 6A and 6B so as to locate the stop target position P1 of the driven gear 51 at the detection position P101 of the home position sensor 101. Accordingly, the clamp part 2, the penetration part 3, and the clinch part 4 stop at respective home positions.

As described above, the timing, at which the clamp part 2 is opened to allow discharging of the paper bundle P can be discharged after the clinching process is completed, is determined based on the rotation amount information acquired based on the position information output from the magnetic sensor 102, so that an optimum discharge timing of the paper bundle can be detected even when the load is changed. Accordingly, by the ON-OFF-ON detection of the home position sensor, it is possible to reduce unnecessary waiting, which is a problem in the related art in which the timing at which the paper bundle P can be discharged is determined. In addition, it is possible to eliminate the possibility that the discharge of the paper bundle P is started before the completion of the clinching process, which is a problem in the related art in which the timing at which the paper bundle P can be discharged is determined with the passage of time since the detection of the home position sensor OFF. Factors of load fluctuation include a thickness of the paper bundle, a paper type, humidity of paper, temperature of the motor, voltage fluctuation, individual mechanical difference, mechanical aging degradation, and the like.

Figure 7A:
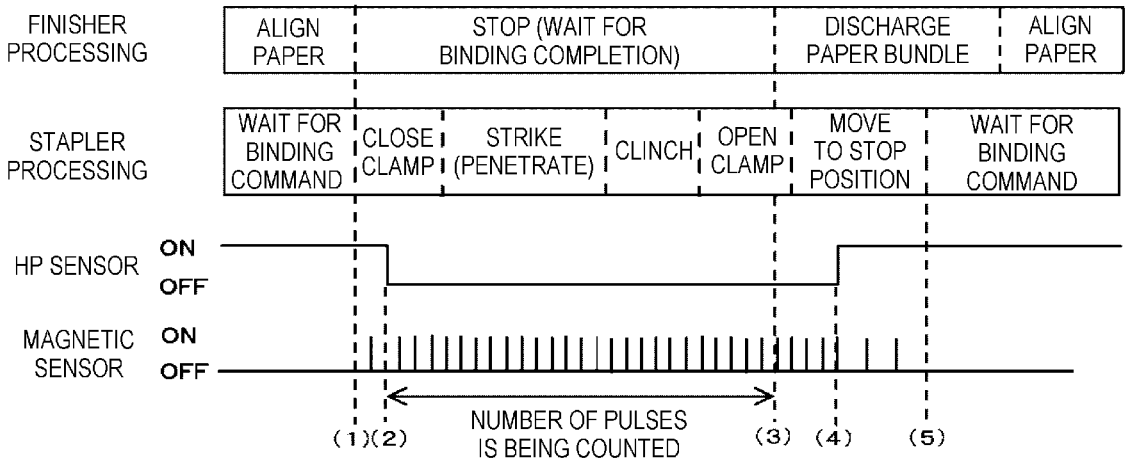
FIG. 7A is a time chart illustrating a second operation example of the electric stapler according to the present embodiment.
Figure 7B:
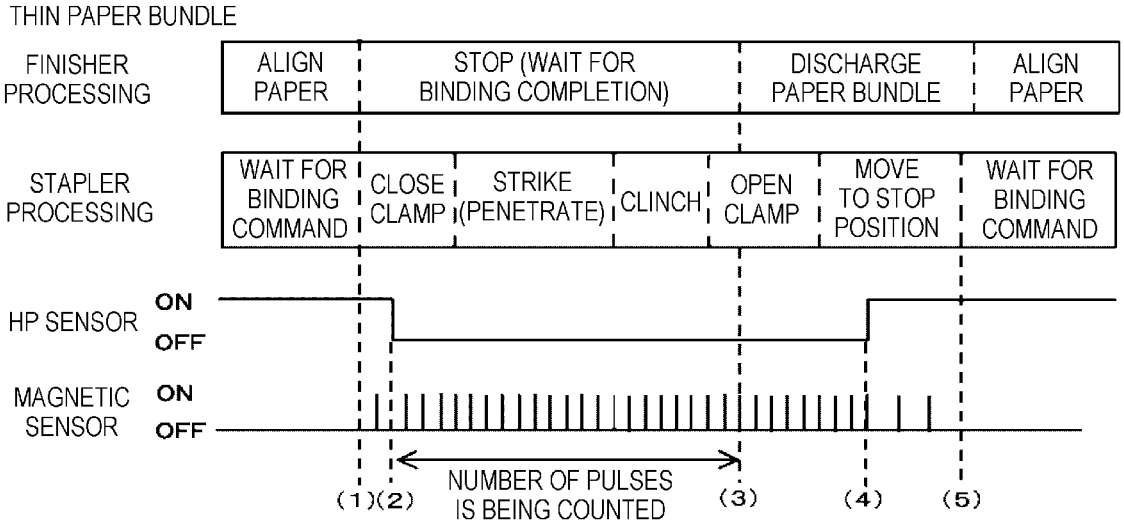
FIG. 7B is a time chart illustrating the second operation example of the electric stapler according to the present embodiment.

FIG. 7 is a time chart illustrating a second operation example of the electric stapler according to the present embodiment. In the second operation example, information specifying a thickness of the paper bundle P is acquired from the image forming device 501A or the post-processing device 502A, and a timing of discharging the paper bundle P is determined according to the thickness of the paper bundle P. FIG. 7A illustrates a case where the thickness of the paper bundle is large due to a large number of sheets of paper to be bound and the like, and FIG. 7B illustrates a case where the thickness of the paper bundle is small due to a small number of sheets of paper to be bound and the like.

When thickness information of the paper bundle P is acquired from the image forming device 501A or the post-processing device 502A, (the paper bundle thickness information acquisition unit of) the control unit 110 calculates, based on the thickness information, the discharge-possible rotation amount D3 (which will be described later) at which the clamping of the paper bundle P is released. The thickness information of the paper bundle P includes information of a thickness of the paper bundle P, the number of sheets of paper to be bound, paper quality, basis weight, and the like.

The post-processing device 502A outputs the thickness information of the paper bundle P to the staple 1A, and outputs a binding command to the stapler 1A when paper alignment processing is completed. Until the paper alignment processing is completed and the binding command is issued in finisher processing in the post-processing device 502A, the control unit 110 of the stapler 1A does not drive the motor 5 and does not execute the stapler processing.

When the binding command from the post-processing device 502A is received correspondingly to a binding command at (1) in FIGS. 7A and 7B, the control unit 110 rotates the motor 5 forward to rotate the driven gear 51 illustrated in FIG. 2 in one direction indicated by the arrow F.

When the home position sensor 101 detects the stop target range end-point position PE of the driven gear 51, that is, HP sensor OFF is detected at (2) in FIGS. 7A and 7B, the control unit 110 starts counting the number of pulses and acquires rotation amount information D1 based on position information output from the magnetic sensor 102. The rotation amount information D1 is the number of pulses obtained by counting the number of pulses generated based on the position information accompanying the rotation of the motor 5.

A rotation amount (the number of pulses) of the motor 5 in a period from when the home position sensor 101 detects the stop target range end-point position PE of the driven gear 51 to when the paper bundle P can be discharged is determined according to the thickness of the paper bundle P to be bound, during which the clamping process, the penetrating process, and the clinching process are completed and the clamp part 2 is opened. The rotation amount of the motor 5 corresponding to the thickness information of the paper bundle and in the period from when the stop target range end-point position PE of the driven gear 51 is detected to when the paper bundle P can be discharged is referred to as a discharge-possible rotation amount D3, during which the clinching process is completed and the clamp part 2 is opened. The control unit 110 sets the discharge-possible rotation amount D3 corresponding to the thickness information of the paper bundle.

When the rotation amount information D1, which is acquired based on the position information output from the magnetic sensor 102 after the stop target range end-point position PE of the driven gear 51 is detected, reaches the discharge-possible rotation amount D3 corresponding to the thickness information of the paper bundle acquired from the post-processing device 502A, (the gripping release detection unit of) the control unit 110 determines that the paper bundle P can be released from the clamping (gripping), and outputs a binding completion notification to the post-processing device 502A correspondingly to counting completion at (3) in FIGS. 7A and 7B.

When the binding completion notification from the stapler 1A is received, the post-processing device 502A performs the discharge processing of the paper bundle P. In a case where there is paper to be bound next when the discharge processing of the paper bundle P is completed, the paper alignment processing is performed to align the paper to be bound next.

When the home position sensor 101 detects the stop target range start-point position PS of the driven gear 51, that is, the HP sensor ON is detected at (4) in FIGS. 7A and 7B, the control unit 110 performs braking control of stopping the driving of the motor 5.

After the HP sensor ON is detected at (4) in FIGS. 7A and 7B, the control unit 110 stops the rotation of the motor 5 correspondingly to motor stop at (5) of FIGS. 7A and 7B so as to locate the stop target position P1 of the driven gear 51 at the detection position P101 of the home position sensor 101. Accordingly, the clamp part 2, the penetration part 3, and the clinch part 4 stop at respective home positions.

The timing, at which the clamp part 2 is opened to allow discharging of the paper bundle P after the clinching process is completed, is determined based on the rotation amount information acquired based on the position information output from the magnetic sensor 102 and the thickness information of the paper bundle acquired from the image forming device 501A, so that an optimum discharge timing of the paper bundle P corresponding to the thickness of the paper bundle can be detected. For example, in a case where the thickness of the paper bundle P is small as illustrated in FIG. 7B, the clamp is released at an earlier timing than in a case where the thickness of the paper bundle P is large as illustrated in FIG. 7A. Accordingly, it is possible to output the binding completion notification from the stapler 1A to the post-processing device 502A at an earlier stage according to the thickness of the paper bundle P. Further, as described in the first operation example, even when the load changes, the optimum discharge timing of the paper bundle P can be detected.

The thickness of the paper bundle P is also defined by the number of sheets of paper to be bound. Therefore, the image forming device 501A illustrated in FIG. 4 outputs paper sheet number information for specifying the number of sheets of paper to be bound to the post-processing device 502A. The post-processing device 502A outputs paper sheet number information to the stapler 1A, and (the paper sheet number acquisition unit of) the control unit 110 of the stapler 1A acquires the paper sheet number information.

When the discharge-possible rotation amount D3 corresponding to the paper sheet number information is set and the rotation amount information D1 reaches the discharge-possible rotation amount D3 corresponding to the paper sheet number information acquired from the post-processing device 502A, (the gripping release detection unit of) the control unit 110 determines that the paper bundle P is released from the clamping (gripping), and outputs the binding completion notification to the post-processing device 502A correspondingly to counting completion at (3) in FIGS. 7A and 7B.

FIG. 8 is a time chart illustrating a third operation example of the electric stapler according to the present embodiment. In the third operation example, a thickness of the paper bundle P is detected based on a load, and a timing of discharging the paper bundle P is determined according to the thickness of the paper bundle P. FIG. 8A illustrates a case where the thickness of the paper bundle is large due to a large number of sheets of paper to be bound and the like, and FIG. 8B illustrates a case where the thickness of the paper bundle is small due to a small number of sheets of paper to be bound and the like.

When the paper alignment processing is completed, the post-processing device 502A illustrated in FIG. 4 outputs a binding command to the stapler 1A. Until the paper alignment processing is completed and the binding command is issued in finisher processing in the post-processing device 502A, the control unit 110 of the stapler 1A does not drive the motor 5 and does not execute the stapler processing.

When the binding command from the post-processing device 502A is received correspondingly to a binding command at (1) in FIGS. 8A and 8B, the control unit 110 rotates the motor 5 forward to rotate the driven gear 51 illustrated in FIG. 2 in one direction indicated by the arrow F.

When the home position sensor 101 detects the stop target range end-point position PE of the driven gear 51, that is, HP sensor OFF is detected at (2) in FIGS. 8A and 8B, the control unit 110 starts counting the number of pulses and acquires rotation amount information D1 based on position information output from the magnetic sensor 102. The rotation amount information D1 is the number of pulses obtained by counting the number of pulses generated based on the position information accompanying the rotation of the motor 5. The (load fluctuation detection unit of) control unit 110 counts pulses generated accompanying the rotation of the motor 5 in a range of (3) in FIGS. 8A and 8B since the detection of the HP sensor OFF at (2) in FIGS. 8A and 8B, detects pulse width fluctuation in this range, and determines magnitude of a load based on the pulse width fluctuation. The control unit 110 may determine the magnitude of the load based on fluctuation in current flowing through the motor 5.

A rotation amount (the number of pulses) of the motor 5 in a period from when the home position sensor 101 detects the stop target range end-point position PE of the driven gear 51 to when the paper bundle P can be discharged is determined according to the thickness of the paper bundle P to be bound, during which the clamping process, the penetrating process, and the clinching process are completed and the clamp part 2 is opened. Therefore, the number $\alpha$ of pulses generated from the start of clamping of the paper bundle P to release thereof is calculated.

As illustrated in FIG. 8A, when the paper bundle P is thick, the pulse width indicating the load fluctuates in the range of (3) (there is a section where the pulse width is large). On the other hand, as illustrated in FIG. 8B, when the thickness of the paper bundle P is small, there is no load fluctuation or the load fluctuation is small in the range of (3), and the fluctuation of the pulse width is within a predetermined range. When the fluctuation of the pulse width is within the predetermined range, it is determined that there is no load fluctuation. As described above, (the thickness estimation unit of) the control unit 110 estimates the thickness of the paper bundle P according to the load fluctuation, and according to the estimated thickness information of paper bundle P, sets discharge-possible rotation amount D4 (the number of pulses) of the motor 5 accumulated until the clamp part 2 is opened to allow discharging of the paper bundle P.

After the stop target range end-point position PE of the driven gear 51 is detected, the control unit 110 acquires the rotation amount information D1 (the number $\alpha$ of pulses) based on the position information output from the magnetic sensor 102, correspondingly to counting of the number of pulses in (4) of FIGS. 8A and 8B. When the rotation amount information D1 reaches the discharge-possible rotation amount D4 corresponding to the load based on the position information output from the magnetic sensor 102, the control unit 110 outputs a binding completion notification to the post-processing device 502A correspondingly to counting completion at (5) in FIGS. 8A and 8B.

When the binding completion notification from the stapler 1A is received, the post-processing device 502A performs the discharge processing of the paper bundle P. In a case where there is paper to be bound next when the discharge processing of the paper bundle P is completed, the paper alignment processing is performed to align the paper to be bound next.

When the home position sensor 101 detects the stop target range start-point position PS of the driven gear 51, the control unit 110 performs braking control of stopping the driving of the motor 5.

The timing, at which the clamp part 2 is opened to allow discharging of the paper bundle P after the clinching process is completed, is determined based on the rotation amount information acquired based on the position information output from the magnetic sensor 102 and the paper bundle thickness information corresponding to the load, so that an optimum discharge timing of the paper bundle corresponding to the thickness of the paper bundle can be detected. For example, in a case where the load is small and the thickness of the paper bundle is small as illustrated in FIG. 8B, the clamp is released at an earlier timing than in a case where the load is large and the thickness of the paper bundle is large as illustrated in FIG. 8A. Accordingly, it is possible to output the binding completion notification from the stapler 1A to the post-processing device 502A at an earlier stage according to the thickness of the paper bundle P. Further, as described in the first operation example, even when the load changes, the optimum discharge timing of the paper bundle can be detected. Further, differently from the second operation example, it is not necessary to acquire the paper bundle thickness information from the image forming device 501A.

REFERENCE SIGNS LIST

1A electric stapler; 2 clamp part; 21 first wall portion; 22 second wall portion; 3 penetration part; 4 clinch part; 5 motor; 51 driven gear; 101 home position sensor; 102 magnetic sensor (rotation amount detection unit); 110 control unit (gripping release detection unit, paper bundle thickness information acquisition unit, paper sheet number acquisition unit, output unit, load fluctuation detection unit, thickness estimation unit); SE stop target range; PS stop target range start-point position; PE stop target range end-point position; P1 stop target position.

What is claimed is:

1. An electric stapler, comprising:

a clamp part that is configured to include a first wall portion and a second wall portion facing each other with a predetermined gap therebetween, in which the first wall portion is movable in directions of approaching and separating from the second wall portion, and that grips a paper bundle inserted between the first wall portion and the second wall portion by moving the first wall portion in the direction of approaching the second wall portion;

a penetration part that causes a staple to penetrate the paper bundle gripped by the clamp part;

a clinch part that bends the staple penetrating the paper bundle to bind the paper bundle;

a gripping release detection unit that detects that the paper bundle is released from gripping after the first wall portion moves in the direction of separating from the second wall portion from a state where the paper bundle is gripped by the clamp part; and an output unit that, after it is detected that the paper bundle is released from gripping of the clamp part, outputs a gripping release signal indicating that the paper bundle is released from gripping of the clamp part to an outside.

2. The electric stapler according to claim 1, further comprising:

a motor that moves the first wall portion, wherein the first wall portion moves in accordance with a rotation amount of the motor, and wherein the gripping release detection unit detects, based on a rotation amount of the motor, that the paper bundle is released from gripping.

3. The electric stapler according to claim 1, further comprising:

a paper bundle thickness information acquisition unit that acquires paper bundle thickness information of the paper bundle inserted into the clamp part, wherein the gripping release detection unit detects, based on the paper bundle thickness information, that the paper bundle is released from gripping of the clamp part.

4. The electric stapler according to claim 1, further comprising:

a paper sheet number acquisition unit that acquires paper sheet number information of the paper bundle inserted into the clamp part, wherein the gripping release detection unit detects, based on the paper sheet number information, that the paper bundle is released from gripping of the clamp part.

5. The electric stapler according to claim 2, further comprising:

a load fluctuation detection unit that detects load fluctuation of the motor at a time when the clamp part grips the paper bundle with the first wall portion and the second wall portion; and a thickness estimation unit that estimates a thickness of the paper bundle based on the load fluctuation, wherein the gripping release detection unit detects, based on the estimated thickness of the paper bundle, that the paper bundle is released from gripping of the clamp part.

6. The electric stapler according to claim 5, wherein the load fluctuation is detected based on a current value of the motor.

7. The electric stapler according to claim 5, wherein the load fluctuation is detected based on a pulse width of a pulse generated accompanying rotation of the motor.

8. A post-processing device that comprises the electric stapler according to claim 1, and performs processing based on the gripping release signal.

9. An image forming system, comprising:

a post-processing device that includes the electric stapler according to claim 1, and performs processing based on the gripping release signal; and an image forming device.

10. An electric stapler, comprising:

a clamp part that is configured to include a first wall portion and a second wall portion facing each other with a predetermined gap therebetween, in which the first wall portion is movable in directions of approaching and separating from the second wall portion, and that grips a paper bundle inserted between the first wall portion and the second wall portion by moving the first wall portion in the direction of approaching the second wall portion;

a penetration part that causes a staple to penetrate the paper bundle gripped by the clamp part;

a clinch part that bends the staple penetrating the paper bundle to bind the paper bundle; and a controller configured to detect that the paper bundle is released from gripping after the first wall portion moves in the direction of separating from the second wall portion from a state where the paper bundle is gripped by the clamp part; and to output a gripping release signal indicating that the paper bundle is released from gripping of the clamp part to an outside after it is detected that the paper bundle is released from gripping of the clamp part.

* * * * *